US007252290B1

(12) United States Patent
Kaselitz

(10) Patent No.: US 7,252,290 B1
(45) Date of Patent: Aug. 7, 2007

(54) GAME METHOD AND APPARATUS

(76) Inventor: Jack Kaselitz, 5321 Bluejay Dr., Holiday, FL (US) 34690

( * ) Notice: Subject to any disclaimer, the term of this patent is extended or adjusted under 35 U.S.C. 154(b) by 118 days.

(21) Appl. No.: 11/079,586

(22) Filed: Mar. 14, 2005

Related U.S. Application Data

(60) Provisional application No. 60/552,700, filed on Mar. 12, 2004.

(51) Int. Cl.
*A63F 9/26* (2006.01)

(52) U.S. Cl. ..... 273/449

(58) Field of Classification Search ..... 273/440, 273/444, 449, 459; 472/106; 482/146, 142, 482/34; D21/412, 688
See application file for complete search history.

(56) References Cited

U.S. PATENT DOCUMENTS

| | | | | | |
|---|---|---|---|---|---|
| 292,254 | A | * | 1/1884 | Rich | 472/106 |
| 1,752,110 | A | * | 3/1930 | Remy | 472/106 |
| D157,939 | S | * | 4/1950 | Castelli | D21/412 |
| D158,703 | S | * | 5/1950 | Westcamp | D21/412 |
| 2,947,009 | A | * | 8/1960 | McKenzie | 5/2.1 |
| 3,075,764 | A | * | 1/1963 | De Lorean | 482/31 |
| 3,389,910 | A | * | 6/1968 | Kanzler, Jr. | 273/449 |
| 3,561,022 | A | * | 2/1971 | James | 5/657 |
| 4,200,292 | A | * | 4/1980 | Slimp, Jr. | 273/258 |
| 4,579,346 | A | * | 4/1986 | Giuntoli | 273/258 |
| 4,589,664 | A | * | 5/1986 | Slimp, Jr. | 273/258 |
| 4,759,542 | A | * | 7/1988 | Hudec | 482/34 |
| 5,447,474 | A | * | 9/1995 | Chang | 472/113 |
| D383,510 | S | * | 9/1997 | Bernardson | D21/688 |
| 5,755,651 | A | * | 5/1998 | Homyonfer et al. | 482/146 |
| 2002/0147087 | A1 | * | 10/2002 | Tollner | 482/147 |

* cited by examiner

*Primary Examiner*—Raleigh W. Chiu
(74) *Attorney, Agent, or Firm*—Kenneth L Tolar

(57) ABSTRACT

A game method and apparatus includes an elongated game board having a platform attached to each of two ends. The game board pivots on a fulcrum in a seesaw type fashion. The game board can be adjustably attached to the fulcrum to compensate for the weight differential between players. Each player stands on a respective platform and alternates jumping up and down thereon in an attempt to displace the other player from his or her platform.

5 Claims, 1 Drawing Sheet

GAME METHOD AND APPARATUS

CROSS REFERENCE TO RELATED APPLICATIONS

This application is entitled to the benefit of provisional application No. 60/552,700 filed on Mar. 12, 2004.

BACKGROUND OF THE INVENTION

The present invention relates to a game method and apparatus designed to enhance balance, coordination, sportsmanship and competition.

DESCRIPTION OF THE PRIOR ART

Various games and methods exist in the prior art, some of which are designed to enhance various physical attributes such as balance and coordination. However, no such conventional games are designed according to the present invention. The present invention provides a unique game method and apparatus that encourages sportsmanship and competition while teaching balance and coordination.

SUMMARY OF THE INVENTION

The present invention relates to a uniquely designed game apparatus and method. The apparatus includes a game board comprising a pair of elongated parallel beams each having a pair of opposing ends, a top surface and a bottom surface. Attached to the top surface of each beam adjacent one of the ends is a platform. A second platform is similarly attached to the beams at the opposing end. Each platform includes an upper surface with a plurality of traction strips positioned thereon. Positioned on the lower surface of each beam is a block member having a plurality of recesses longitudinally disposed thereon. The game apparatus also includes a fulcrum including a pair of spaced, parallel triangular panels with three rods extending therebetween. The uppermost rod is received within one of the recesses on each of the block members allowing the game board to pivot back and forth on the fulcrum in a seesaw type fashion.

The game method according to the present invention involves a user placing the game board onto the fulcrum by inserting the uppermost fulcrum rod into one of the recesses on each block member. Each game player steps onto one of the platforms. The starting position of the game board should be substantially horizontal. If the weight differential between the two players is significant, the device can be adjusted to offset such differential by placing the upper rod into one of the other board recesses. Once the board is properly balanced, each user takes turns jumping up and down trying to displace the other player from the board.

It is therefore an object of the present invention to provide a game method and apparatus that enhances balance and coordination.

It is another object of the present invention to provide a game method and apparatus that is entertaining.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
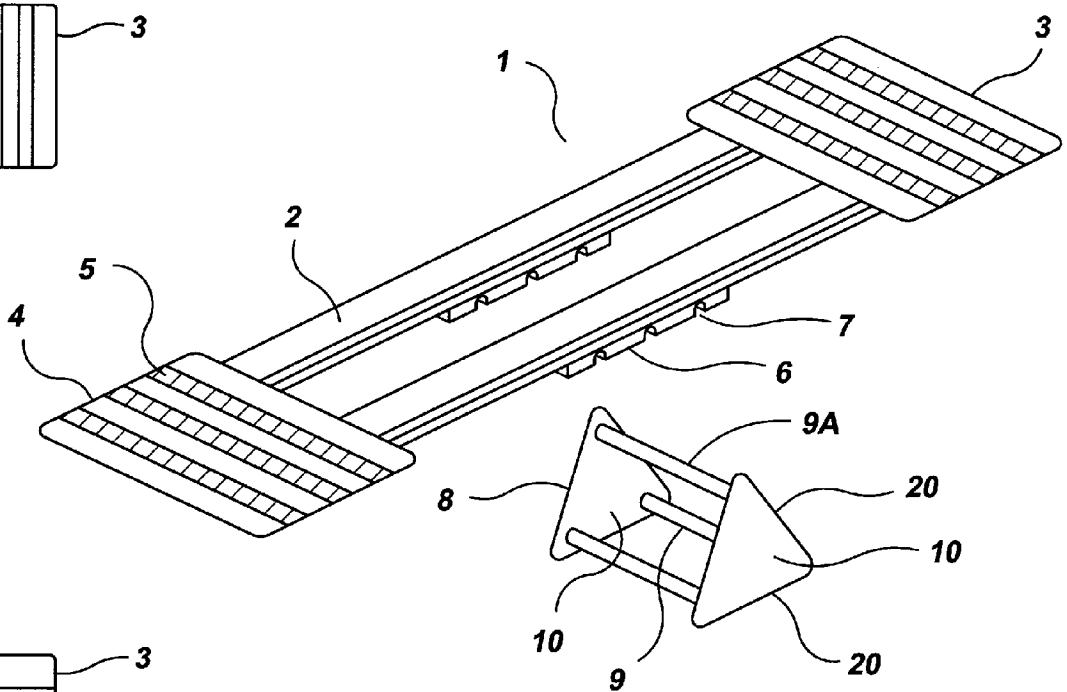
FIG. 1 is a perspective view of device.
Figure 2:
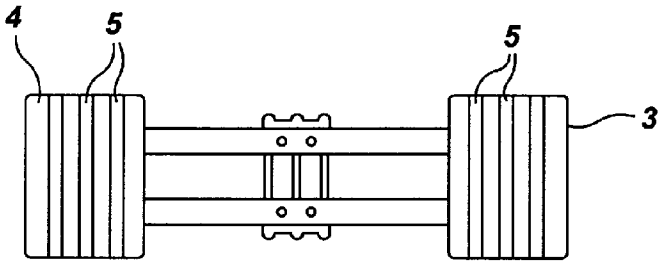
FIG. 2 is a top view of the device.
Figure 3:
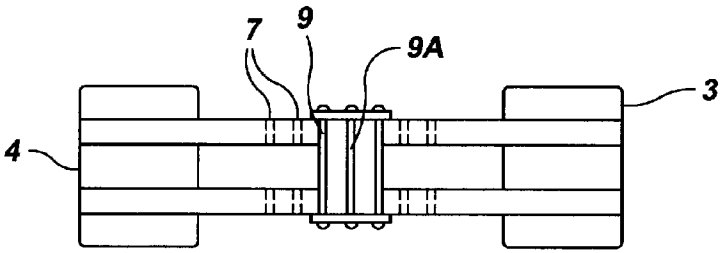
FIG. 3 is a is bottom view of the device.

The present invention relates to a uniquely designed game apparatus and method. The apparatus includes a game board 1 comprising a pair of elongated parallel beams 2 each having a pair of opposing ends, a top surface and a bottom surface. Attached to the top surface of each beam adjacent one of the ends is a first platform 3. A second platform 4 is similarly attached to the beams at the opposing end. Each platform includes an upper surface with a plurality of traction strips 5 positioned thereon.

Disposed on the lower surface of each beam is a block 6 member having a plurality of recesses 7 longitudinally disposed thereon. The game apparatus also includes a fulcrum 8 including a pair of spaced parallel triangular panels 10 with three rods 9 extending therebetween. Each rod is secured to the panels using nuts and bolts or similar fasteners. An uppermost rod 9A is received within one of the recesses on each of the block members allowing the game board to pivot back and forth on the fulcrum in a seesaw type fashion. Preferably, the panels are formed into scalene triangles such that the length of each edge 20 thereof is unequal to the others. Accordingly, a user can vary the height of the game board by simply rotating the fulcrum 120 degrees.

The game method according to the present invention involves a user placing the game board onto the fulcrum by inserting the uppermost fulcrum rod into one of the recesses on each block member. Each game player steps onto one of the platforms. The starting position of the game board should be substantially horizontal when both players are standing on a respective platform. If the weight differential between the two players is significant, the relative position of the game board can be adjusted to offset such differential by placing the uppermost rod into one of the other board recesses. Once the board is properly balanced, each user takes turns jumping up and down trying to displace the other player from his or her platform. The last player remaining on the platform wins.

The above described device is not limited to the exact details of construction and arrangement of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A game apparatus comprising:

an elongated game board having a first end and an opposing second end, a top surface and a bottom surface;

a first platform attached to the top surface of said game board, adjacent the first end thereof;

a second platform attached to the top surface of said game board, adjacent the second end thereof;

said first platform and said second platform each including an upper surface with a plurality of traction strips positioned thereon;

a block member attached to the lower surface of said game board, said block member having a plurality of recesses longitudinally disposed thereon;

a fulcrum including a pair of spaced parallel triangular panels with at least one rod extending therebetween, said rod received within one of said recesses allowing said game board to pivot thereon, said panels formed into scalene triangles such that each panel has edges of unequal length allowing a user to rotate the fulcrum to adjust the height of the rod and the game board.

2. A game method for at least two players comprising the steps of:

providing a game board having a lower surface with a block member thereon;

placing a pair of opposing platforms on said game board;

forming a plurality of recesses on said block member;

providing a fulcrum formed of a pair of spaced triangular panels with at least one rod therebetween;

placing the game board onto the fulcrum by inserting the rod into one of the recesses on the block member;

each of said two players stepping onto one of the platforms;

each of said two players alternating jumping up and down on one of the platforms in an attempt to displace the other of said two players from one of the platforms.

3. The game method according to claim 2 further comprising the steps of assuring that a starting position of the game board is substantially horizontal when both players are standing on a respective platform.

4. The game method according to claim 3 further comprising the steps of placing the rod into one of the other board recesses if the weight differential between the two players is significant.

5. The game method according to claim 3 wherein winning is accomplished by a final player remaining on a respective platform.

* * * * *